United States Patent [19]

Ishida

[11] 4,257,371

[45] Mar. 24, 1981

[54] SPLIT OPERATION TYPE MULTI-CYLINDER INTERNAL COMBUSTION ENGINE

[75] Inventor: Yasuhiko Ishida, Mishima, Japan

[73] Assignee: Toyota Jidosha Kogyo Kabushiki Kaisha, Toyota, Japan

[21] Appl. No.: 8,037

[22] Filed: Jan. 31, 1979

[30] Foreign Application Priority Data

Feb. 10, 1978 [JP] Japan ..... 53-13626

[51] Int. Cl.[3] ..... F02M 13/04; F02D 17/00

[52] U.S. Cl. ..... 123/198 F; 261/23 A

[58] Field of Search ..... 123/198 F, 198 DB, 124 R; 261/23 A

[56] References Cited

U.S. PATENT DOCUMENTS

| | | | |
|---|---|---|---|
| 2,085,818 | 7/1937 | Messinger | 123/198 F |
| 2,114,655 | 4/1938 | Leibing | 123/198 F |
| 2,623,617 | 12/1952 | Snyder et al. | 123/198 F |
| 2,919,686 | 1/1960 | Mick | 123/198 F |
| 4,019,479 | 4/1977 | Garabedian | 123/198 F |
| 4,076,003 | 2/1978 | Garabedian | 123/198 F |
| 4,107,921 | 8/1978 | Lizuka | 123/198 F |
| 4,109,634 | 8/1978 | Garabedian | 123/198 F |
| 4,130,102 | 12/1978 | Churchill | 123/198 F |

*Primary Examiner*—Ira S. Lazarus

*Attorney, Agent, or Firm*—Kenyon & Kenyon

[57] ABSTRACT

An internal combustion engine having a plurality of cylinders which are divided into a first cylinder group and a second cylinder group. The engine comprises a first throttle valve and a second throttle valve for controlling the amount of combustible mixture fed into the first cylinder group and the second cylinder group, respectively. The engine further comprises a first actuating means for rotating the first throttle valve faster when the engine load is low than when engine load is high, and for rotating the second throttle valve only when the engine load level is higher than a predetermined level. This first actuating means is energized only when the engine temperature is higher than a predetermined value. The engine further comprises a second actuating means for rotating both of the first and second throttle valves in accordance with the engine load level. This second actuating means is energized only when the engine temperature is equal to or lower than the above-mentioned predetermined value. Furthermore, the engine comprises control means for fully opening the second throttle valve and for stopping the supply of fuel to the second cylinder group, when the engine load level is lower than the above-mentioned level. This control means is energized only when the first actuating means is energized.

8 Claims, 6 Drawing Figures

SPLIT OPERATION TYPE MULTI-CYLINDER INTERNAL COMBUSTION ENGINE

DESCRIPTION OF THE INVENTION

The present invention relates to a split operation type multi-cylinder internal combustion engine having a number of cylinders divided into a plurality of groups, in which the respective cylinder groups are separately controlled according to the level of the load of the engine.

Generally, in an internal combustion engine, the engine power is controlled by controlling the amount of combustible mixture fed into the cylinders. This amount of combustible mixture is in proportion to the amount of air fed into the cylinders, and is controlled by throttle valves equipped in air intake passages of the engine. It has been known that when the opening degree of the throttle valve is small, indicative of reduced air intake and light load conditions, working losses (pumping losses) of the engine on intake and exhaust strokes become large, so that the rate of fuel consumption is increased. Inversely, when the opening degree is large, indicative of more air intake and high load conditions, the rate of fuel consumption decreases.

Based on this recognition, there has been proposed that, in a split operation type multi-cylinder internal combustion engine for use in automobiles, when the power demands of the engine are small, in other words, when the engine load requirements are light, the fuel supply to certain cylinders be cut off, so that the engine is operated only on the remaining cylinders, thus causing an increase in the engine loads imposed on the operating cylinders in an attempt to decrease the rate of fuel consumption, and throttles serving the inactivated cylinders be fully opened to decrease pumping losses (see, for example, U.S. Pat. No. 2,875,742, No. 2,918,047, No. 2,919,686).

An object of the present invention is to improve the internal combustion engine of the split operation type so as to provide an internal combustion engine operable with less working losses and, hence, with increased fuel economies.

Another object of the invention is to provide an internal combustion engine of the split operation type having smooth operational properties during the warming up operation of the engine.

According to the present invention, there is provided an internal combustion engine having a plurality of cylinders which are divided into a first cylinder group and a second cylinder group, the first cylinder group having a first intake passage and a first fuel supply means, the second cylinder group having a second intake passage and a second fuel supply means. The engine of the present invention comprises: a first throttle valve fixed to a first valve shaft and arranged in the first intake passage for controlling the amount of combustible mixture fed into the first cylinder group; a second throttle valve fixed to a second valve shaft and arranged in the second intake passage for controlling the amount of combustible mixture fed into the second cylinder group; a first actuating means for rotating the first valve shaft faster when the level of the load of the engine is low than when the level of the load of the engine is high, and for rotating the second valve shaft only when the level of the load of the engine is higher than a predetermined level, wherein the first actuating means is energized only when the engine temperature is higher than a predetermined value; a second actuating means for rotating both the first valve shaft and the second valve shaft in accordance with the level of the load of the engine, wherein the second actuating means is energized only when the engine temperature is equal to or lower than the above-mentioned predetermined value, and; a control means for fully opening the second throttle valve and for stopping the supply of fuel to the second cylinder group when the level of the load of the engine is lower than the above-mentioned predetermined level, wherein the control means is energized only when the first actuating means is energized.

The above-mentioned and other related objects and features of the present invention will become more apparent from the description of the present invention, presented hereinbelow, with reference to the accompanying drawings, as well as from the appended claims.

DESCRIPTION OF PREFERRED EMBODIMENTS

Figure 1:
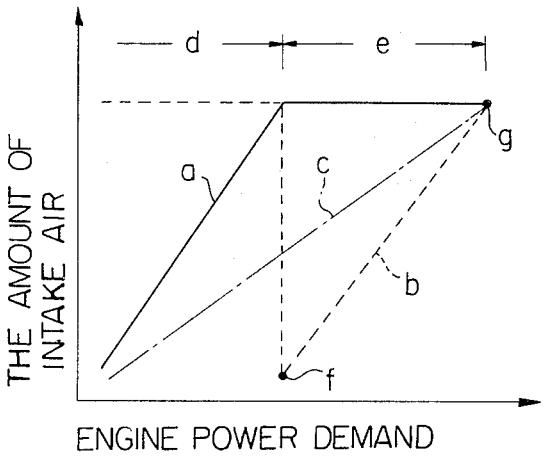
FIG. 1 is a graph showing an ideal or desirable relationship between the engine power demand and the amount of intake air of the engine according to the present invention.

FIG. 1 is a graph showing an ideal or desirable relationship between engine power requirements and quantities of intake air of an internal combustion engine according to the present invention, which engine comprises cylinders divided into two cylinder groups in this embodiment. In the graph, the abscissa indicates the power demand or the degree of depression, or degree of rotation, of the accelerator pedal at a given rotational speed of the engine, whereas the ordinate represents the quantities of air fed into the first and second cylinder groups or the degree of opening of throttle valves corresponding respectively to the first and second cylinder groups. Also in the graph, a solid line a shows the characteristics of the first cylinder group to be activated all the time, while a broken line b indicates characteristics of the second cylinder group which is disabled during low power operation of the engine. In this ideal engine, while the output power required from the engine is small, the second cylinder group draws a maximum amount of air but is rendered inactive by stopping the fuel supply thereto, and only the first cylinder group develops power in accordance with the quantity of air fed therein. As the power demand of the engine increases so that the amount of intake air fed into the first cylinder group reaches its maximum, indicative of maximum power, the quantity of intake air to be fed into the second cylinder group is rendered minimum or zero, and then the fuel supply is concurrently re-opened to activate the second cylinder group. In the higher range of power demands, the first cylinder group maintains its maximum air induction thus developing its maximum power, the total output power of the engine being then controlled in proportion of the amount of air fed into the second cylinder group. When the temperature of the engine is low, that is, during the warming-up operation of the engine, the engine is controlled in such a way that both the first and second cylinder groups are operated with an equal quantity of air developing an equal power, as shown by a chain line c in FIG. 1, thereby operating all the cylinders uniformly.

In the graph of FIG. 1, indicated by reference character d is an area in which the second cylinder group is inactivated while only the first group is activated, by e an area in which both cylinder groups are co-operated, at f a point at which the activation is started and, hence, the fuel supply of the second cylinder group is started, and at g a maximum power point (maximum load) of the engine.

Figure 2:
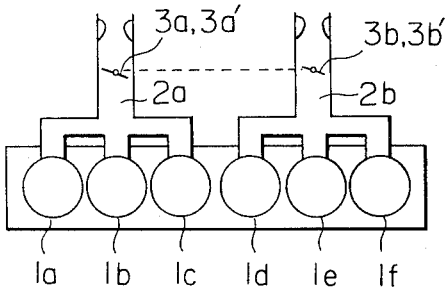
FIG. 2 is a schematic view of an embodiment according to the present invention.

FIG. 2 illustrates a six cylinder, carburetor equipped, internal combustion engine embodying the invention and having characteristics close to the ideal split operation characteristics just described. In the drawing, reference numerals 1*a* to 1*f* indicate respective cylinders, among which, cylinders 1*a*, 1*b* and 1*c* constitute a first cylinder group activated all the time, and cylinders 1*d*, 1*e* and 1*f* constitute a second cylinder group inactivated during low power operation of the engine. 2*a* and 2*b* represent air intake passages for the first and second cylinder groups, respectively. 3*a* and 3*b* indicate throttle valves provided in the air intake passages 2*a* and 2*b*, respectively.

Figure 3:
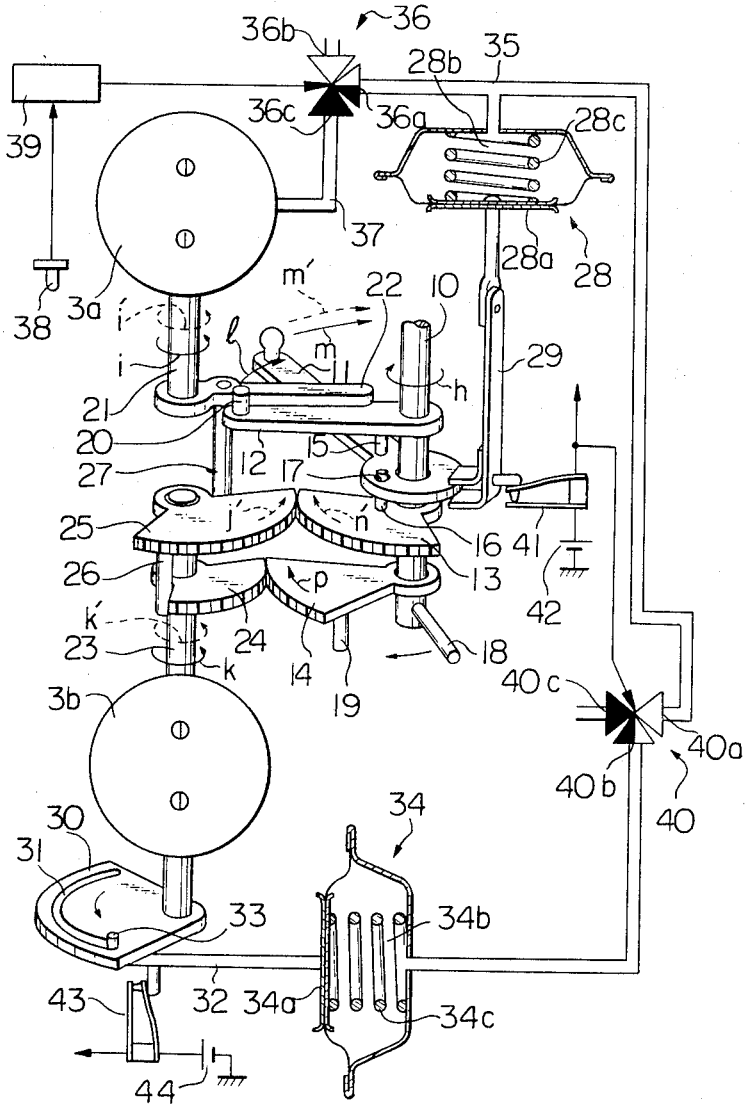
FIG. 3 is a view illustrating the construction of a throttle valve actuating mechanism of the above-mentioned embodiment.

FIG. 3 is a view illustrating an embodiment of a mechanism for actuating the throttle valves 3*a* and 3*b* illustrated in FIG. 2. In this embodiment, actuating shafts of the throttle valves 3*a* and 3*b* are arranged coaxially with each other. An accelerator lever 11 is loosely mounted on a shaft 10 so as to be slidable axially along the shaft 10 and is adapted to be rotatable around the shaft 10 in response to the depression of an accelerator pedal, not shown. An arm 12 is secured to the shaft 10. Gears 13 and 14 are mounted coaxially and rotatably on the shaft 10. A projecting pin 15 secured to the arm 12, a projecting pin 16 secured to a side of the gear 13, and a through-hole 17 provided in the accelerator lever 11 are positioned in such a way that they are brought into alignment together when the throttles 3*a* and 3*b* are in an initial position, namely, an idling position. At this initial position, the accelerator lever 11 is able to slide along the shaft 10 to cause the through-hole 17 to be engaged selectively with either of the pins 15 or 16. A further projecting pin 18 is secured to the shaft 10. This pin 18 is positioned in such a way that it becomes urged against a projecting pin 19, secured to one side of the gear 14, as the shaft 10 is turned in the direction of an arrow h through a suitable angle determined empirically, for example, through one-half of its full rotational angle, and when the throttle 3*b* is situated in its initial position.

A projecting pin 20 is fixed at a free end of the arm 12. When the shaft 10 rotates in the direction of the arrow h, the pin 20 slides along one side of an arm 22 secured to an actuating shaft 21 of the throttle valve 3*a* as it is held in pressure contact with the arm 22, so that the actuating shaft 21 is turned in the direction of an arrow i. On the other hand, a gear 24 is secured coaxially to an actuating shaft 23 of the throttle valve 3*b* and another gear 25 is mounted coaxially and pivotably on the actuating shaft 23. The gear 25 is engaged with the gear 13, the gear ratio between these gears being 1/1. Also, the gear 24 is engaged with the gear 14, the gear ratio between them being predetermined at a suitable value, for example ½, which is determined empirically as a function of the position of the pin 18. Secured to the gear 25 is a projecting pin 26 which, when the gear 25 is turned in the direction of an arrow j', engages with the gear 24 to cause it to move circumferentially, thereby rotating the actuating shaft 23 in the direction of an arrow k'. Alternatively, the actuating shaft 23 may be provided with a projecting pin fixed directly thereto which is capable of abutting perpendicularly against the pin 26, so that when the gear 25 rotates in the direction of the arrow j', it moves by the pin 26 to cause the shaft 23 to be rotated in the direction of the arrow k'. To the arm 22 is secured a projecting pin 27 which is moved upon rotation in the direction of the arrow j' of the gear 25, causing the arm 22 to be rotated in the direction of the arrow j' and thereby resulting in the rotation in the same direction of the actuating shaft 21.

Indicated by 28 is a diaphragm device having a diaphragm 28*a* to which is connected a rod 29, which, in turn, is adapted to move parallel to the axis of the shaft 10, causing the accelerator lever 11 to slide axially along the shaft 10. Secured to the actuating shaft 23 of the throttle valve 3*b* is a sectoral lever 30 in which there is provided a slot 31 extending along an arc of a circle, in which slot a bent portion or a projecting pin 33, provided at an end of a rod 32 engages. Another end of the rod 32 is connected to a diaphragm 34*a* of a diaphragm device 34, so that when the rod 32 is driven to the right, as viewed in the drawing, upon actuation of the diaphragm device 34, the sectoral lever 30 is turned to move the actuating shaft 23 of the throttle 3b in the direction of an arrow k, thereby causing the throttle valve 3*b* to be fully opened. Throttle valves 3*a* and 3*b* are spring-biased in the reverse direction against the direction of arrow i and k by any suitable springs, not shown, and are adapted to resume their idle position when the accelerator lever 11 is in its reference position and the diaphragm device 34 is not activated.

Vacuum chamber 28*b* of the diaphragm device 28 is communicated through a conduit 35 with a port 36*a* of an electromagnetic valve 36. The valve 36 is adapted to communicate ports 36*a* and 36*c* with each other when energized. Port 36*c* is communicated with the air intake passage 2*a* (FIG. 2) of the engine by means of a conduit 37 which is opened downstream of the throttle 3*a*. When deenergized, the valve 36 is adapted to connect the port 36*a* to another port 36*b* which is communicated with the atmosphere. Activation and inactivation of the vacuum valve 36 are controlled by the cooperation of a sensor 38 for detecting the temperature of the cooling water of the engine, and an electric circuit 39 which compares the detected temperature with a preset value and determines whether to supply electric current to the electromagnetic valve when the detected temperature exceeds the preset value or not to supply electric current when the temperature is below the preset value. Operation of the valve 36 may otherwise be controlled by means of a power source and a water temperature sensing switch (not shown) capable of effecting on-off action depending on the temperature of the cooling water.

Port 36*a* of the electromagnetic valve 36 is also communicated with a port 40*a* of a second electromagnetic valve 40. The valve 40 is designed in such a way that during inactivation, the port 40*a* is connected to a port 40*b* which is communicated with the vacuum chamber 34*b* of the diaphragm device 34, but upon operation, the port 40*b* is connected to a port 40*c* communicated with the atmosphere. Operation and deactivation of the valve 40 are controlled by a voltage source 42 and a switch 41, which is on-off controlled in response to displacement of the rod 29.

When the rod 29 is propelled downwardly, as viewed in the drawing, so that the pin 16 of the gear 13 comes into engagement with the through-hole 17 provided in the accelerator lever 11, the switch 41 is brought to an "on" position to energize the electromagnetic valve 40 and actuate a fuel supply mechanism, to be described later-on, to open the fuel supply also to the air intake passage 2*b*.

Contrary to this, when the rod 29 is driven upwards, as viewed in the drawing, to cause the through-hole 17 to be engaged with the pin 15 of the arm 12, the switch 41 is brought to an "off" position, whereby the valve 40 is inactivated and the activation of the fuel supply mechanism is stopped.

There is also provided a second switch 43 which is on-off controlled in accordance with movement of the rod 32, to control the actuation of the above-mentioned fuel supply mechanism for the air intake passage 2*b*. More specifically, the switch 43 is constructed in such a way that, when the vacuum is applied to the diaphragm device 34 to move the rod 32 to the right, as viewed in the drawing, it is rendered "off", and when the rod 32 is in another position it is rendered "on", thereby supplying electric voltage from the source 44 to the aforementioned fuel supply mechanism.

Figure 4:
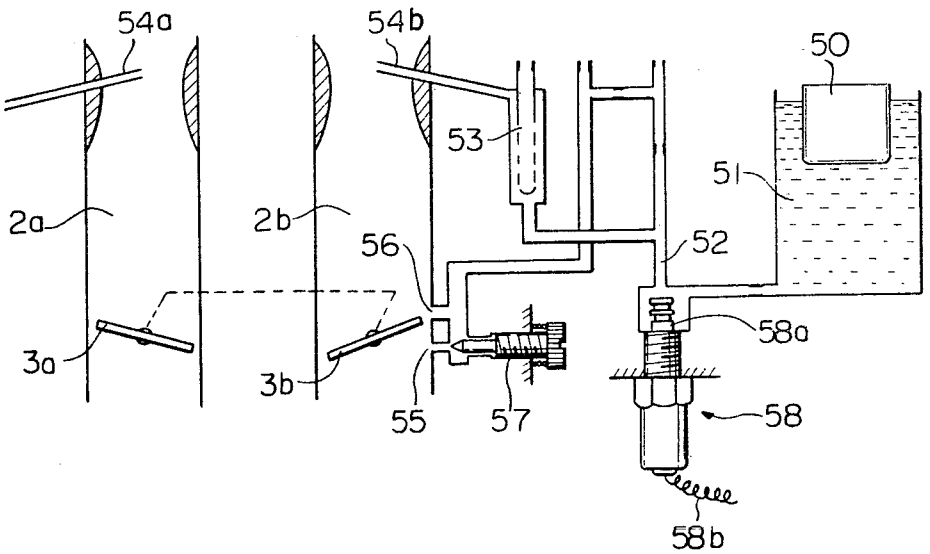
FIG. 4 is a view illustrating the construction of a fuel supply mechanism of the above-mentioned embodiment.

FIG. 4 is a view illustrating the fuel supply mechanism employed in the embodiment of FIG. 2, particularly the fuel supply mechanism for the second cylinder group. In FIG. 4, there are shown air intake passages 2*a* and 2*b*, throttle valves 3*a* and 3*b*, float 50, float chamber 51, fuel passage 52, main well tube or main emulsion tube 53, main nozzles 54*a* and 54*b*, idle port 55, slow port 56, and idle adjust screw 57. On the fuel passage 52, for feeding fuel to the air intake passage 2*b* having the throttle 3*b*, there is provided an electromagnetic valve 58. This valve 58 is adapted, when energized, to shift a valve member 58*a* downwards, as shown in the drawing, to allow fuel to be fed to the air intake passage 2*b* and, hence, to the second cylinder group. The valve member 58*a* is adapted to be shifted upwards when the valve is not activated, to shut off the fuel passage 52, thereby cutting off the fuel supply to the air intake passage 2*b* and the second cylinder group. The input terminal of the electromagnetic valve 58 is connected via a lead 58*b* to the aforementioned switches 41 and 43 (FIG. 3).

Operation of the embodiment illustrated in FIGS. 2, 3 and 4 is as follows.

FIG. 3 illustrates a position in which the engine is in a cool and idle condition. During the warming-up operation of the engine, the temperature of the cooling water is below the preset value, so that the electromagnetic valve 36 is in an inactivated, (deenergized) state as described above. Thus, the vacuum chamber 28*b* of the diaphragm device 28 is influenced by the atmospheric pressure. As a result, the rod 29 remains depressed downwards by the action of the spring 28*c*, so that the through-hole 17 of the accelerator lever 11 becomes fitted with the pin 16. In this state, the switch 41 is in its "on" position, whereby the electromagnetic valve 58 (shown in FIG. 4), for stopping the fuel supply, is excited to allow fuel to be fed also to the second cylinder group. The engine, therefore, operates with all cylinders being fueled. Since the switch 41 is rendered "on", the second electromagnetic valve 40 is energized, so that the vacuum chamber 34*b* of the diaphragm device 34 is under the influence of atmospheric pressure with its rod 32 moved to the left, in the drawing, by the action of the spring 34*c*.

With the foregoing arrangement, if the accelerator lever 11 is rotated in the direction of an arrow m′ of a broken line, the gear 13 will turn in the direction of an arrow n′ of a broken line the same degree, causing the gear 25 to be rotated in the direction of an arrow j′ of a broken line the same degree. As a result, the pin 26 turns the gear 24, together with the throttle 3*b*, in the direction of an arrow k′ and the gear 25 forces the pin 27 to be rotated together with the throttle 3*a* in the direction of an arrow i′. Consequently, the throttle valves 3*a* and 3*b* are opened an equal degree.

As the engine warms up, the temperature of the cooling water exceeds a preset value. This is detected by the water temperature sensor 38, which in turn energizes the electromagnetic valve 36. Upon actuation of the electromagnetic valve 36, the vacuum prevailing in the air intake passage 2*a*, downstream of the throttle valve 3*a*, is reflected in the diaphragm device 28, so that the rod 29 tends to be pulled upwardly. However, if the accelerator lever 11 is not situated in its initial position, viz., idling position, the accelerator lever 11 will not slide upwardly because the hole 17 is out of alignment with the pin 15. Accordingly, unless the accelerator lever 11 is returned back to its initial position, the engine continues to be operated with all the cylinders operating at an equal power, even though the engine is sufficiently warmed.

Figure 5:
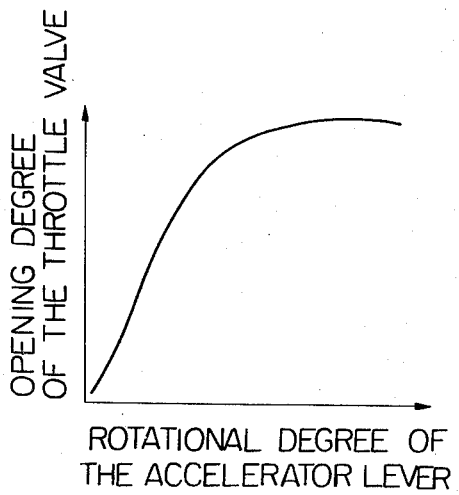
FIG. 5 is a graph showing a relationship between the rotational degree of the accelerator lever and the opening degree of the throttle valve; and, FIG. 6 is a view illustrating the construction of another throttle valve actuating mechanism.

When the accelerator lever 11 is returned to the initial position, the hole 17 is brought into alignment with the pin 15, so that the lever 11 is forced to slide upwardly by the action of the vacuum being applied to the diaphragm device 28, whereby the hole 17 disengages from the pin 16 and then engages with the pin 15. Simultaneously, the switch 41 is rendered "off" to disable the electromagnetic valve 40, so that the vacuum is applied to the diaphragm device 34, thus moving the rod 32 to the right, as viewed in the drawing. Consequently, the throttle 3*b* becomes nearly fully opened and, simultaneously therewith, the switch 43 is rendered "off", so that the aforementioned electromagnetic valve 58 for stopping the fuel supply is inactivated, whereby the fuel passage 52 is shut off so as to stop the feeding of fuel to the second cylinder group. Then, upon rotation of the accelerator lever 11 in the direction of an arrow m, the arm 12 in turn rotates the same degree in the direction of an arrow l, whereby the pin 20 urges the arm 22 so as to rotate the arm 22. As a result, the actuation shaft 21 is turned in the direction of the arrow i, causing the throttle valve 3*a* to be opened. The characteristics between the rotational degree of the accelerator lever and the opening degree of the throttle valve 3*a* is shown in the graph of FIG. 5. Referring to the graph, the opening speed of the throttle valve 3*a* is high with respect to a region in which the rotational angle of accelerator lever 11, that is, the rotational angle of the throttle valve, is small. When the rotational angle of the accelerator lever 11 attains about one half of its full rotational angle, the throttle valve 3*a* becomes nearly fully opened, and the opening speed of the throttle valve is reduced thereafter. Even though the accelerator lever 11 is further rotated, the throttle valve 3*a* remains nearly fully opened. It follows that the throttle valve 3*a* effects a behavior which is close to the ideal one shown at line a in FIG. 1. When the arm 12 is moved, the shaft 10 is turned integrally therewith in the direction of the arrow h. However, the gears 13 and 14 remain immobile, since they are free with respect to the shaft 10, and in addition, the gear 14 has been fully rotated in the direction of the arrow p, via the gear 24, by the throttle valve 3*b* which is fully opened, so that the pin 18 is not brought into contact with the pin 19 even though the shaft 10 is turned a large extent.

When the accelerator lever 11 is turned through about one half of its full rotational angle, causing the throttle valve 3*a* to be nearly fully opened, the pressure in the air intake passage 2*a* becomes nearly equal to atmospheric pressure. This results in the spring force of the spring 34*c* overcoming the attractive force produced by the negative pressure in the diaphragm device 34, so that the rod 32 is moved, thus allowing the throttle valve 3*b* to be returned back to the fully closed or idling position by the action of a return spring not shown. And the switch 43 is simultaneously rendered "on" to activate the electromagnetic valve 58 (FIG. 4) of the fuel supply mechanism, which opens the fuel passage, thereby supplying fuel also to the second cylinder group. The positions of pins 18 and 19 are previously set in such a manner that they come into contact with each other at this moment. The timing at which the throttle valve 3*b* becomes fully closed may be selected in any suitable manner by adjusting the pressing force of the spring 34*a* of the diaphragm device 34.

When the accelerator lever 11 is further rotated, after operating the engine on all cylinders by starting the fuel supply to the remaining second cylinder group, the applied force from the accelerator lever 11 is transmitted to the actuating shaft 23 via the shaft 10, pin 18, pin 19, gear 14, and gear 24, and the throttle valve 3*b* is opened. The gear ratio between gears 14 and 24 is selected in such a way that the throttle valve 3*b* is brought from the fully closed to the fully opened condition in accordance with the accelerator lever 11 effecting its rotation through the latter half angle.

Figure 6:
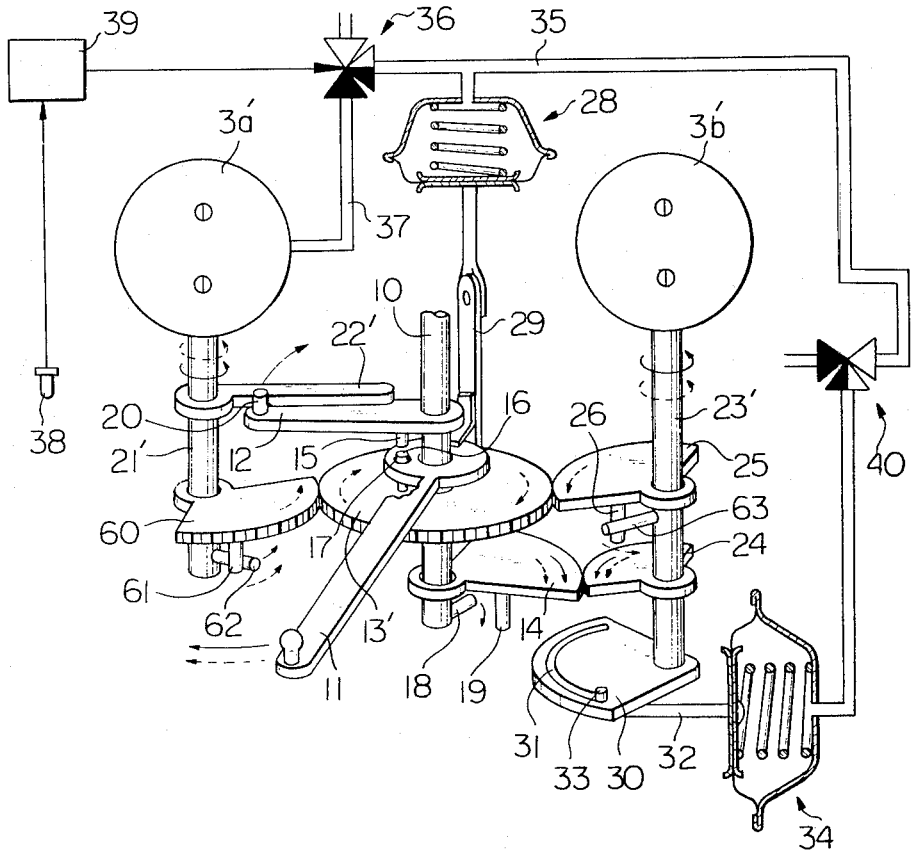

FIG. 6 is a view illustrating another embodiment of the mechanism for actuating the throttle valves 3*a*′ and 3*b*′ shown in FIG. 2. In this embodiment, the actuating shafts 21′ and 23′ of the throttle valves 3*a*′ and 3*b*′ are positioned in parallel. The valve actuating mechanism as shown in FIG. 6 has substantially the same construction and operation as that illustrated in FIG. 3, except for the structural difference due to the different positional relationship between the actuating shafts 21′ and 23′. In the mechanism of FIG. 6, the actuating shaft 21′ of the throttle 3*a*′ is provided, mounted rotatably thereon, with a coaxial gear 60, which engages with a gear 13′, which carries and a projecting pin 61 secured to a side thereof in such a manner as to come into perpendicular contact with a projecting pin 62 fixed to the shaft 21′ when the gear 60 rotates. The above described construction of the mechanism of FIG. 6 is provided in place of the combination of the pin 27 on the arm 22 and the associated gear 25 in the mechanism of FIG. 3 and, thus, the effect thereof is exactly the same. The mechanism of FIG. 6 also differs from that of FIG. 3 in that the gears 24 and 25, sectoral lever 30 and throttle 3*b*′ are mounted on the actuating shaft 23′ in a different order and that the pin 26 of the gear 25 is adapted to coact with a pin 63 directly secured to the actuating shaft 23′, in place of coacting with the gear 24. Although in FIG. 6, the switches 41 and 43, and electric voltage sources 42 and 44, are omitted from the drawing for the purpose of simplication, it should be noted that equivalent switches and sources are in fact provided in the mechanism of FIG. 6.

In FIGS. 3 and 6, gears 13, 14, 24, 25 and 60 are shown as having a sectoral configuration. However, these gears may be circular. In that case, however, the gears 24 and 25 in FIG. 3 must be provided with arcuate slots for passing pins 26 and 27 there-through.

Although the invention has been described with reference to embodiments thereof as applied to an internal combustion engine with a carburetor, it will be apparent that the present invention is also applicable under the entirely same concept to an internal combustion engine of the fuel injection type insofar as it incorporates throttle valves.

As explained in detail hereinbefore, since the engine according to the present invention is provided with means to return the throttle valve serving the inactivated cylinder group to the closed position thereof when the engine is reinstated to the full cylinder operation from the partial cylinder operation, it is possible to maintain the throttle valve serving the cylinder group which is activated all the time in a nearly fully open condition during high load full cylinder operation. As a result, the rate of fuel consumption can be reduced to a large extent not only during light load operation, as was possible in the prior art engine, but also during high load operation on full cylinders.

In addition, it is possible to obtain smooth operational characteristics even during a warming operation of the engine, such as when the engine is first started, since the engine according to the invention is adapted to be operated with all the cylinders developing an equal power during a warming-up operation. Moreover, the construction of the engine according to the present invention is such that the change-over from the full cylinder equal power operation during warming-up to the split operation after warming-up, is limited to be effected only during the idling condition, no sudden transition occurs in the engine power due to a change-over that might take place while the engine is being operated under load thereby smooth operational characteristics can be obtained.

As many widely different embodiments of the present invention may be constructed without departing from the spirit and scope of the present invention, it should be understood that the present invention is not limited to the specific embodiments described in this specification, except as defined in the appended claims.

I claim:

1. An internal combustion engine having a plurality of cylinders which are divided into a first cylinder group and a second cylinder group, said first cylinder group having a first intake passage and a first fuel supply means, said second cylinder group having a second intake passage and a second fuel supply means, said engine comprising:

a first valve shaft arranged in said first intake passage;

a first throttle valve fixed to the first valve shaft for controlling the amount of combustible mixture fed into said first cylinder group in response to rotation of said first valve shaft;

a second valve shaft arranged in said second intake passage;

a second throttle valve fixed to the second valve shaft for controlling the amount of combustible mixture fed into said second cylinder group in response to rotation of said second valve shaft;

acceleration control means movable between an idle position and a full load position;

a first actuating means operatively engageable between the acceleration control means and the first and second valve shafts such that a given increment of movement of the acceleration control means will produce a greater angle of rotation of the first valve shaft when the level of the load of said engine is low than when the level of the load of said engine is high, and such that movement of the acceleration control means will produce rotation of said second valve shaft only when the level of the load of said engine is higher than a predetermined level;

a second actuating means operatively engageable between the acceleration control means and the first and second valve shafts such that movement of the acceleration control means will produce rotation of both said first valve shaft and said second valve shaft in accordance with the level of the load of said engine;

means for operatively engaging said first actuating means only when the engine temperature is higher than a predetermined value and for operatively engaging said second actuating means only when the engine temperature is equal to or lower than said predetermined value;

a control means for fully opening said second throttle valve and for stopping the supply of fuel to said second cylinder group when the level of the load of said engine is lower than said predetermined level; and means for energizing said control means only when said first actuating means is operatively engaged between said acceleration control means and said first and second valve shafts.

2. An internal combustion engine as claimed in claim 1, wherein said acceleration control means comprises:

an accelerator lever rotated in accordance with the level of the load of said engine, and wherein said first actuating means comprises:

a first lever means connected to said first valve shaft;

a second lever means engageable in response to said operatively engaging means with said accelerator lever for rotation therewith only when the engine temperature is higher than said predetermined value, said second lever means making sliding contact along one side of said first lever means for causing said first lever means to rotate at a progressively decreasing ratio with respect to rotation of the second lever means as said accelerator lever rotates from the idle to the full load position;

a first rotary member connected to said second valve shaft;

a second rotary member engageable in response to said operatively engaging means with said accelerator lever for rotation therewith only when the engine temperature is higher than said predetermined value; and means for engaging said second rotary member with said first rotary member for rotation therewith only when the angle of rotation of said accelerator lever exceeds a predetermined degree.

3. An internal combustion engine as claimed in claim 2, wherein said accelerator lever is engageable in response to said operatively engaging means with said second lever means or said second rotary member only when said accelerator lever is in an initial position.

4. An internal combustion engine as claimed in claim 1, wherein said acceleration control means comprises:

an accelerator lever rotated in accordance with the level of the load of said engine, and wherein said second actuating means comprises:

a first rotary member engaged with and rotated with both said first valve shaft and said second valve shaft, and a second rotary member engageable with said first rotary member in response to said operatively engaging means, said second rotary member being engaged with and rotated with said accelerator lever only when the engine temperature is equal to or lower than said predetermined value.

5. An internal combustion engine as claimed in claim 4, wherein said accelerator lever is engageable in response to said operatively engaging means with said second rotary member only when said accelerator lever is in the idle position.

6. An internal combustion engine as claimed in claim 1, wherein said control means comprises:

a first detecting means for detecting that said first actuating means is operatively engaged;

a vacuum operated control means for fully opening said second throttle valve when the level of vacuum produced in said first intake passage is reduced below a predetermined level and, furthermore, when said first detecting means detects that said first actuating means is operatively engaged;

a second detecting means for detecting that said vacuum operated control means is energized; and a fuel valve means for stopping the supply of fuel to said second cylinder group when said second detecting means detects that said vacuum operated control means is energized.

7. An internal combustion engine as claimed in claim 1, 2, 4 or 6, wherein said first and second valve shafts are positioned in parallel with each other.

8. An internal combustion engine as claimed in claim 1, 2, 4, or 6, wherein said first valve shaft is coaxially positioned with said second valve shaft.

* * * * *

UNITED STATES PATENT AND TRADEMARK OFFICE

CERTIFICATE OF CORRECTION

PATENT NO. : 4,257,371

DATED : March 24, 1981

INVENTOR(S) : Yasuhiko Ishida

It is certified that error appears in the above—identified patent and that said Letters Patent is hereby corrected as shown below:

Col. 6, line 57, change "actuation" to --actuating--.

Col. 7, line 58, after "13'" delete " , " change "which carries and" to --and which carries--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*